US012329254B2

(12) United States Patent
Luo

(10) Patent No.: US 12,329,254 B2
(45) Date of Patent: Jun. 17, 2025

(54) ANGLE-ADJUSTABLE UMBRELLA WITHOUT ROPE

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 226 days.

(21) Appl. No.: 18/313,626

(22) Filed: May 8, 2023

(65) Prior Publication Data

US 2023/0371663 A1 Nov. 23, 2023

(30) Foreign Application Priority Data

May 19, 2022 (CN) ..... 202210553780.7

(51) Int. Cl.
*A45B 17/00* (2006.01)
*A45B 19/10* (2006.01)
*A45B 23/00* (2006.01)

(52) U.S. Cl.
CPC ..... *A45B 17/00* (2013.01); *A45B 19/10* (2013.01); *A45B 2023/0012* (2013.01); *A45B 2023/0037* (2013.01); *A45B 2023/0056* (2013.01)

(58) Field of Classification Search
CPC ..... A45B 2023/0056
See application file for complete search history.

(56) References Cited

U.S. PATENT DOCUMENTS

| | | | | |
|---|---|---|---|---|
| 6,401,735 | B1 * | 6/2002 | Chou | A45B 23/00 135/21 |
| 6,588,438 | B1 * | 7/2003 | Steiner | A45B 25/06 135/21 |
| 6,694,993 | B2 * | 2/2004 | Chou | E04H 15/58 135/98 |
| 6,725,870 | B1 * | 4/2004 | Lo | A45B 23/00 135/21 |
| 9,167,873 | B2 * | 10/2015 | May | A45B 23/00 |
| 10,925,362 | B1 * | 2/2021 | Luo | A45B 25/14 |
| 2006/0054285 | A1 * | 3/2006 | Louis | A45B 23/00 160/53 |
| 2015/0068566 | A1 * | 3/2015 | Ma | A45B 23/00 135/20.1 |
| 2021/0386166 | A1 * | 12/2021 | Luo | A45B 25/02 |
| 2023/0292891 | A1 * | 9/2023 | Luo | A45B 23/00 |

* cited by examiner

*Primary Examiner* — Noah Chandler Hawk
(74) *Attorney, Agent, or Firm* — Wang Law Firm, Inc.

(57) ABSTRACT

An angle-adjustable umbrella has a column, a transverse rod, a tilted rod, an umbrella frame and a clutch mechanism. The tilted rod has a first tilted rod and a second tilted rod, and the top end of the first tilted rod is hinged to the top of the column, the bottom end thereof is rotatably connected to a connector on the second tilted rod through a tilted rod joint. The transverse rod has a first transverse rod and a second transverse rod which are connected each other by connecting pieces, and the connecting pieces are coupled to the tilted rod. The bottom end of the transverse rod is connected to a slider joint through the clutch mechanism and the top end thereof is rotatably connected to the upper nest in the umbrella frame.

8 Claims, 8 Drawing Sheets

ANGLE-ADJUSTABLE UMBRELLA WITHOUT ROPE

TECHNICAL FIELD OF THE INVENTION

The present invention relates to the field of umbrellas, and in particular to an angle-adjustable umbrella without rope.

BACKGROUND OF THE INVENTION

As an outdoor leisure appliance, umbrellas are widely used in square, beach, park, courtyard and other leisure places, providing people with comfortable cool space. Since the umbrellas used outdoor are generally large and high, umbrellas are mostly folded or unfolded by ropes. It is time-consuming and labor-consuming, low efficient and inconvenient to use, and the strength and length of the rope cannot be accurately controlled. It is possible that the whole product cannot be used due to deficiencies in strength and size of the rope. Moreover, once the product is damaged, it is difficult to maintain or replace the rope inside the product. At present, there are umbrellas that are not folded or unfolded by ropes. However, due to their structural restrictions, these umbrellas cannot be adjusted in their angle although they can be folded or unfolded. Meanwhile, since the irradiation angle of solar rays is different at different positions and different times, a good shading effect cannot be achieved if the umbrella is always supported at a same angle. With the improvement of living standards, umbrellas that maintain the largest shading area for the canopy at different times, are labor-saving to fold/unfold and easy to fix and can rotate the shading umbrella frame become the development trend in the future. Therefore, it is necessary to design an umbrella without rope that is convenient and labor-saving to unfold and adjustable in shading angle.

SUMMARY OF THE INVENTION

It is an object of the present invention to provide an angle-adjustable umbrella without rope which is reasonable in structure and easy to unfold and fold, that is, the umbrella of the present invention can be unfolded without any rope and the shading angle of the umbrella is adjustable.

For achieving the above object, the angle-adjustable umbrella comprises a column having a sliding block slidably sleeved on the column; a transverse rod having a top end and a bottom end; a tilted rod having a top end and a bottom end; an umbrella frame having an upper nest and a lower nest; a clutch mechanism for adjusting the angle of umbrella frame; wherein, the tilted rod comprises a first tilted rod and a second tilted rod, and the top end of the first tilted rod is hinged to the top of the column, the bottom end of the first tilted rod is rotatably connected to a connector on the second tilted rod through a tilted rod joint, the bottom end of the second tilted rod is hinged to the lower nest in the umbrella frame; the transverse rod comprises a first transverse rod and a second transverse rod which are connected with each other by connecting pieces, and the connecting pieces are coupled to the tilted rod, the bottom end of the transverse rod is connected to a slider joint through the clutch mechanism, the slider joint is rotatably connected to the sliding block slidably sleeved on the column, and the top end of the transverse rod is rotatably connected to the upper nest in the umbrella frame.

Preferably, the umbrella frame at least comprises an upper segment, the upper nest, the lower nest, long ribs and short ribs; the upper nest is connected to the upper segment, and rotatably connected to the top end of long ribs; one end of each short rib far away from the lower nest is rotatably connected to the middle portion of the long ribs, and the other end of each short rib is rotatably connected to the lower nest.

Preferably, the umbrella frame further comprises a plurality of support ribs and a middle nest, one end of each support rib is rotatably connected to the middle nest, the other end of each support rib is rotatably connected to the long ribs near the upper nest.

Preferably, the clutch mechanism at least comprises a lower clutch gear, an upper clutch gear, a clutch gear spring, a lever and a lever fixation seat; the lower clutch gear has a concave cavity on the bottom and can be telescopically mounted on the slider joint, the clutch gear spring is disposed in the concave cavity to make the lower clutch gear be kept upward; the upper clutch gear is rotatably mounted on the slider joint through a bearing and is axially limited by a nut, and the rear end of the upper clutch gear is connected to the lever fixation seat; a mounting groove located on a side of the lever fixation seat is rotatably attached to the lever, and the end of the lever near the mounting groove is resisted against the end face of the upper clutch gear, so that the lower clutch gear is separated from the upper clutch gear against the spring force.

Preferably, the lower clutch gear has a stop collar on its upper end face.

Preferably, the front end of the lever fixation seat is reduced in diameter and a connecting sleeve is disposed on the lever fixation seat through an inner bushing; the lower side of the connecting sleeve has an opening, and is attached to the lever capable of rotating by connecting pieces.

Preferably, a labor-saving mechanism comprising an air spring, a sliding block in the middle nest and a guide sleeve is disposed in the upper segment; the air spring and the sliding block in the middle nest are located inside the upper segment, and a top end of the air spring is connected to the sliding block in the middle nest through a screw, the bottom end of the air spring is connected to the guide sleeve, and then connected to the upper segment through the guide sleeve, the sliding block in the middle nest is connected to the middle nest after passing through a guide hole on the wall of the upper segment.

Preferably, a connecting slot is formed on the tilted rod joint, and the connector on the second tilted rod has a connecting portion which extends into the connecting slot to be connected by a shaft pin.

Preferably, the first transverse rod and the second transverse rod are connected with each other by the connecting pieces disposed on two sides, and a space is formed between the connecting pieces to couple the connector.

Preferably, the sliding block further comprises slider handrails, a spring pin, a handle and a pulley block; the slider handrails are disposed on the sliding block which is connected to the pulley block located in a slide rail in the column, and the spring pin is fitted with a positioning port on the opening of the slide rail, and, the action of the spring pin is controlled by the handle.

Compared with the prior art, the present invention has the following advantages. The umbrella is easy to unfold and fold and can be unfolded without any rope. In combination with the clutch mechanism, the shading angle can be adjusted conveniently. By mounting the stop collar at the contact position of the upper and lower clutch gear and the lever fixation seat and mounting the inner bushing inside the lever fixation seat, it is smoother to rotate the lever. In addition, the labor-saving mechanism can effectively solve the problem of excessive thrust in folding or unfolding the umbrella and the overall structure is rational and practical.

The reference numbers in figures and the corresponding components are listed as follows: 1—an adapter, 2—a cover, 3—an umbrella frame, 20—a tilted rod, 200—a transverse rod, 21—a first transverse rod, 22—a first tilted rod, 23—a tilted rod joint, 23*a*—a connecting slot, 24*a*—a connecting portion, 25—connecting pieces, 26—a second transverse rod, 27—a second tilted rod, 31*a*—an upper nest, 31*b*—a first connector, 31*c*—long ribs, 31*d*—support ribs, 31*e*—a middle nest, 31*f*—an upper segment, 31*j*—short ribs, 31*i*—an umbrella hat, 31*k*—an upper nest cover, 31*m*—an umbrella frame connector, 31*n*—a sliding block in the middle nest, 31*p*—an air spring, 31*q*—a guide sleeve, 31*r*—a lower nest, 31*s*—an umbrella nest support ribs, 31*t*—a lower nest cover, 41*a*—a column, 41*b*—a handle, 41*c*—a slider joint, 41*d*—a stop collar, 41*e*—an inner bushing, 41*f*—an upper clutch gear, 41*i*—a bearing, 41*m*—a lower clutch gear, 41*n*—a clutch gear spring, 41*u*—a sliding block, 41*p*—a lever, 41*q*—a first sliding block handrail, 41*r*—a spring pin, 41*s*—a second sliding block handrail, 41*t*—a pulley block, 41*v*—a nut, 41*w*—a lever fixation seat, 41*y*—a mounting groove, 41*z*—a connecting sleeve, 41—a clutch mechanism.

DETAILED DESCRIPTION OF THE INVENTION

The present invention will be further described below in detail by embodiments with reference to the accompanying drawings.

Figure 1:
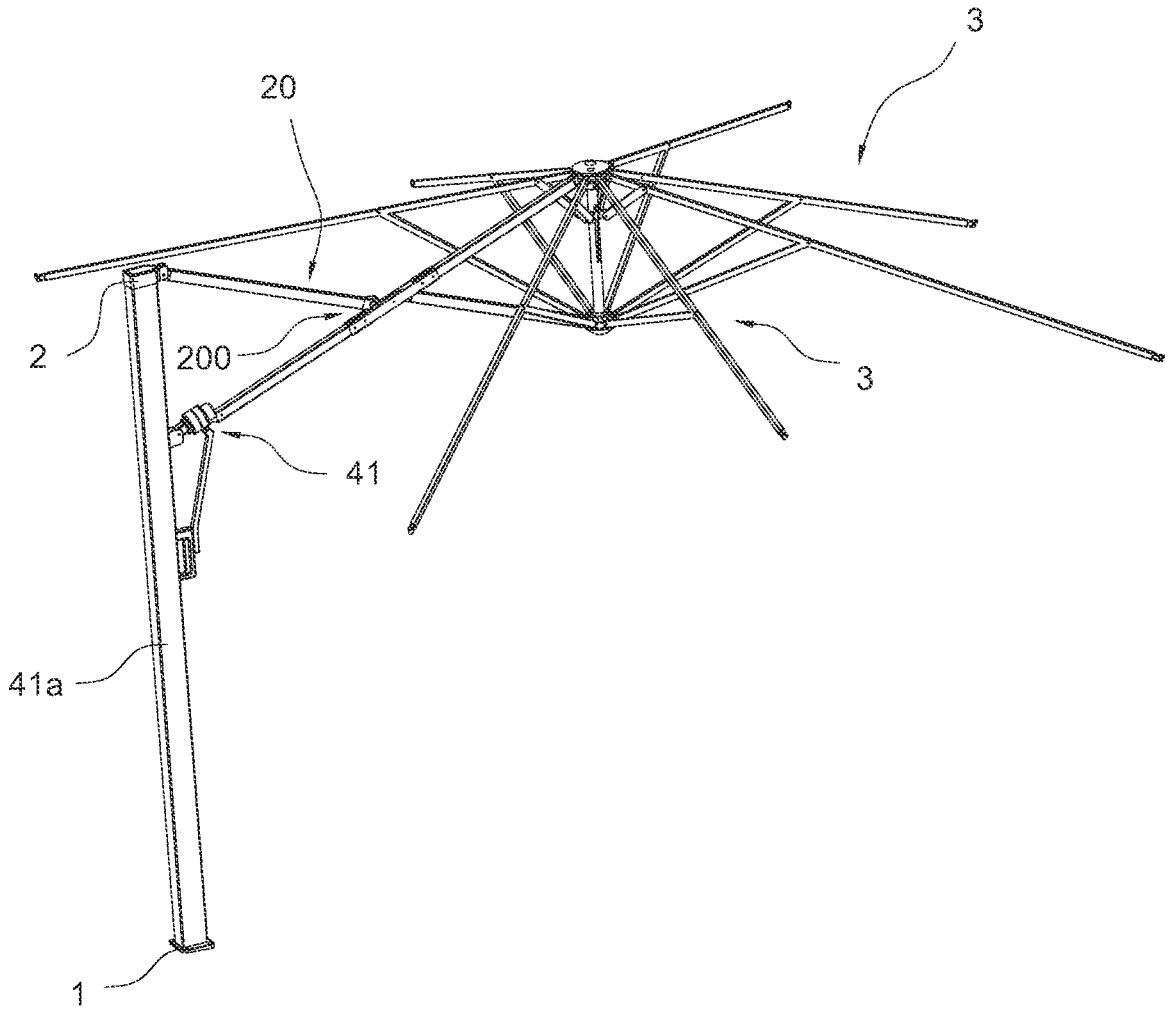
FIG. 1 is a perspective view of an angle-adjustable umbrella without rope in an unfolding state according to an embodiment the present invention.
Figure 2:
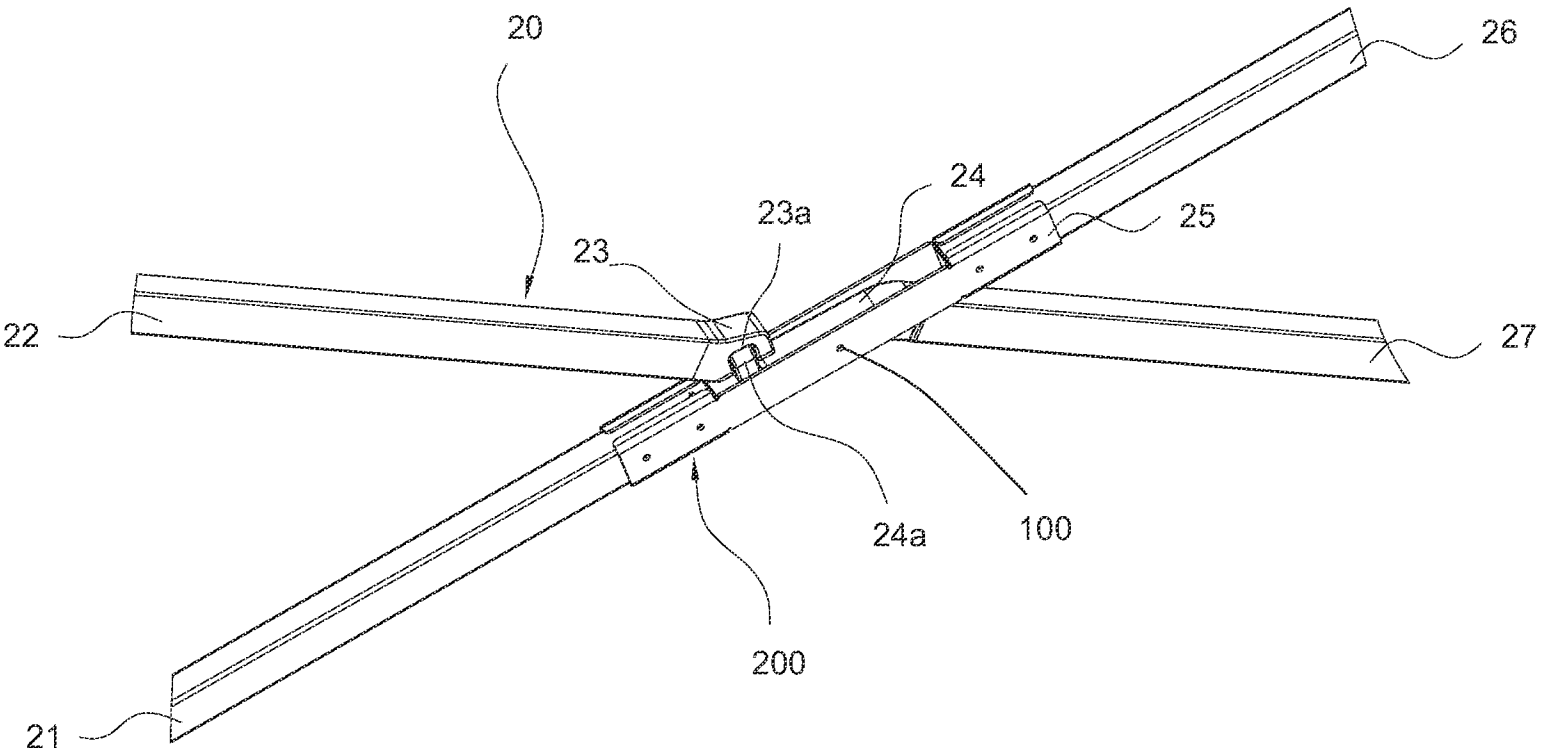
FIG. 2 is a perspective view of the hinge component of the transverse rod and the tilted rod of the umbrella according to the embodiment.
Figure 3:
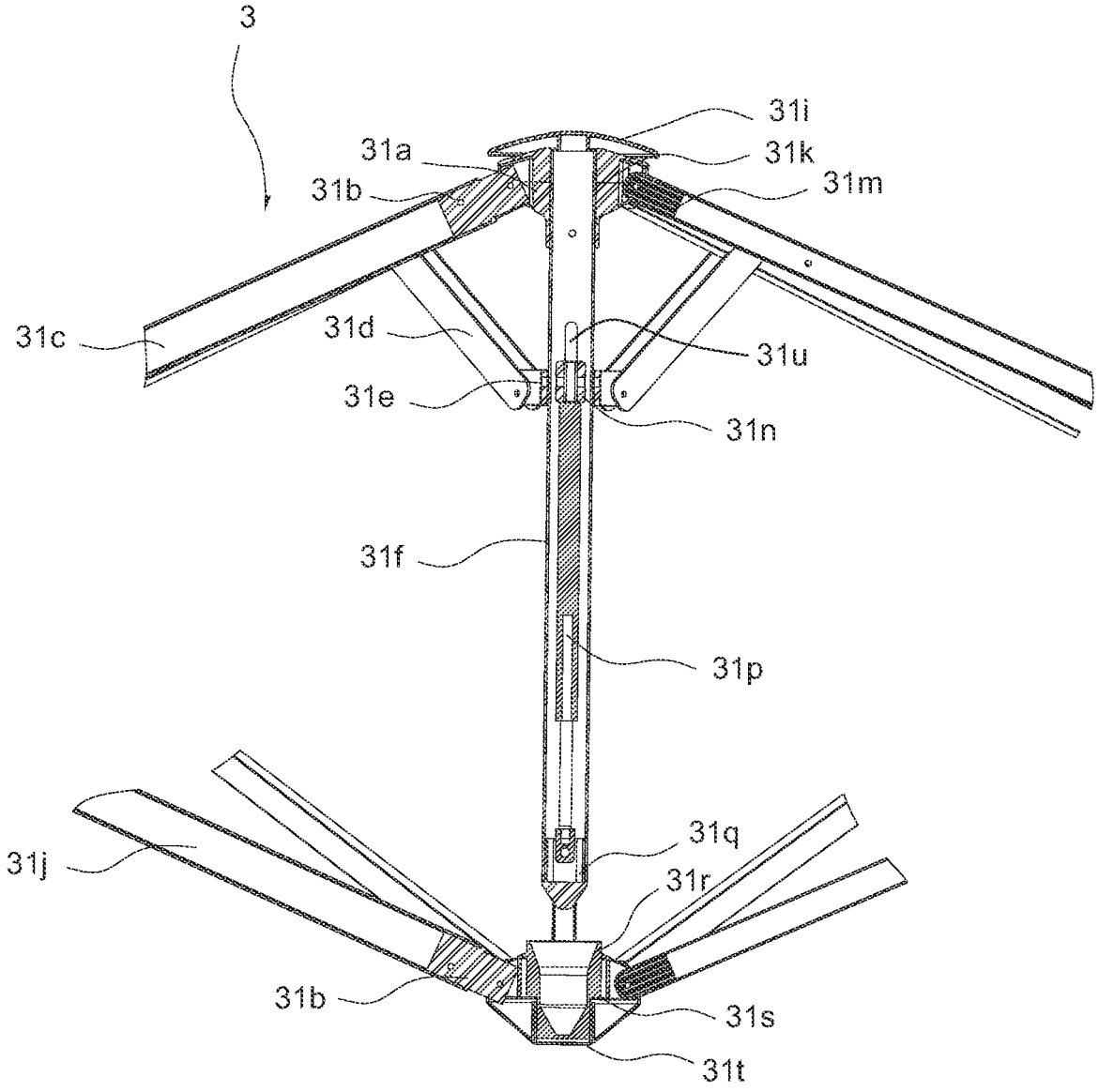
FIG. 3 is a perspective view of an umbrella frame and the labor-saving mechanism of the umbrella according to the embodiment.
Figure 4:
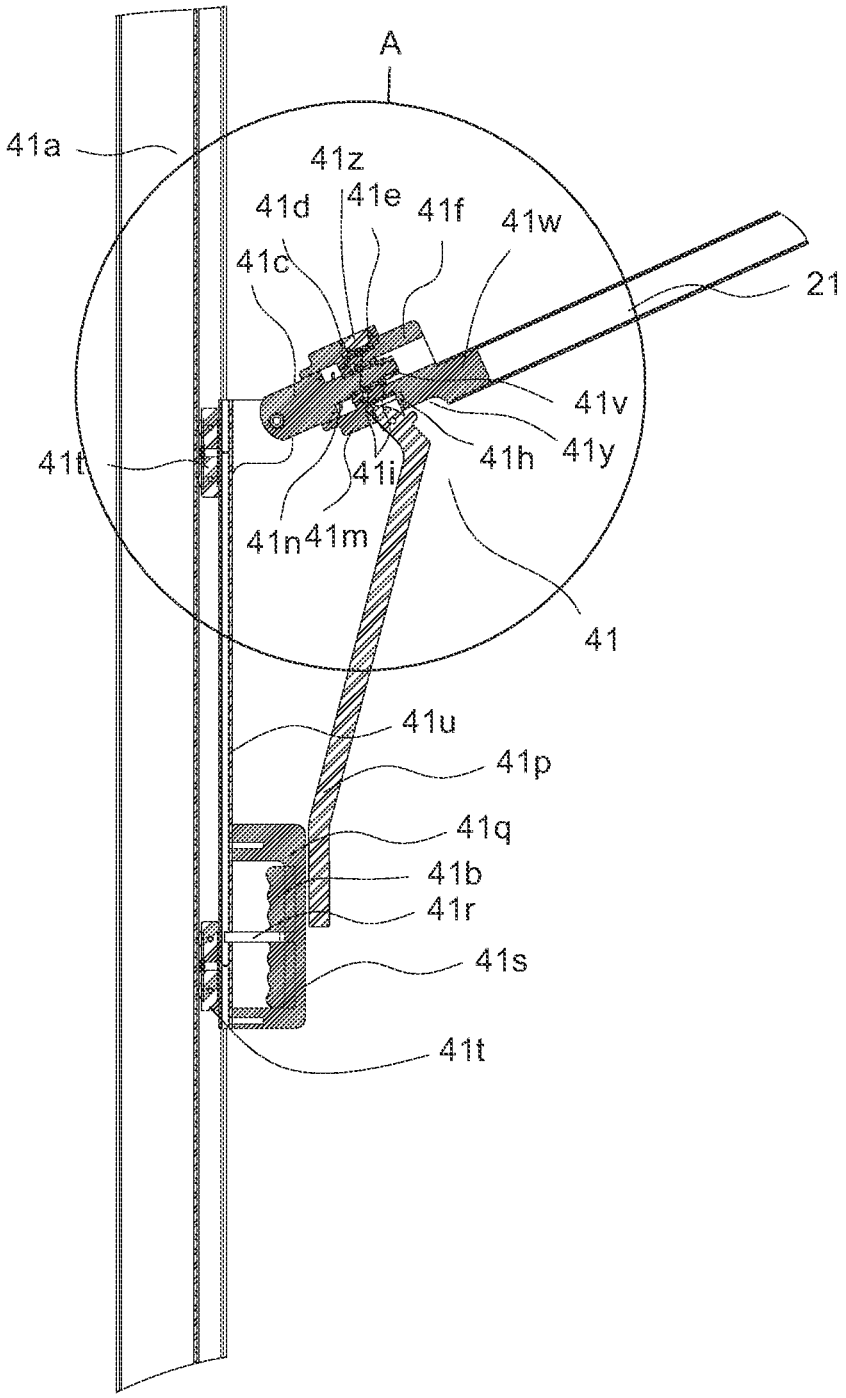
FIG. 4 is a perspective view of a clutch mechanism and a sliding block (in a combined state) of the umbrella according to the embodiment.
Figure 5:
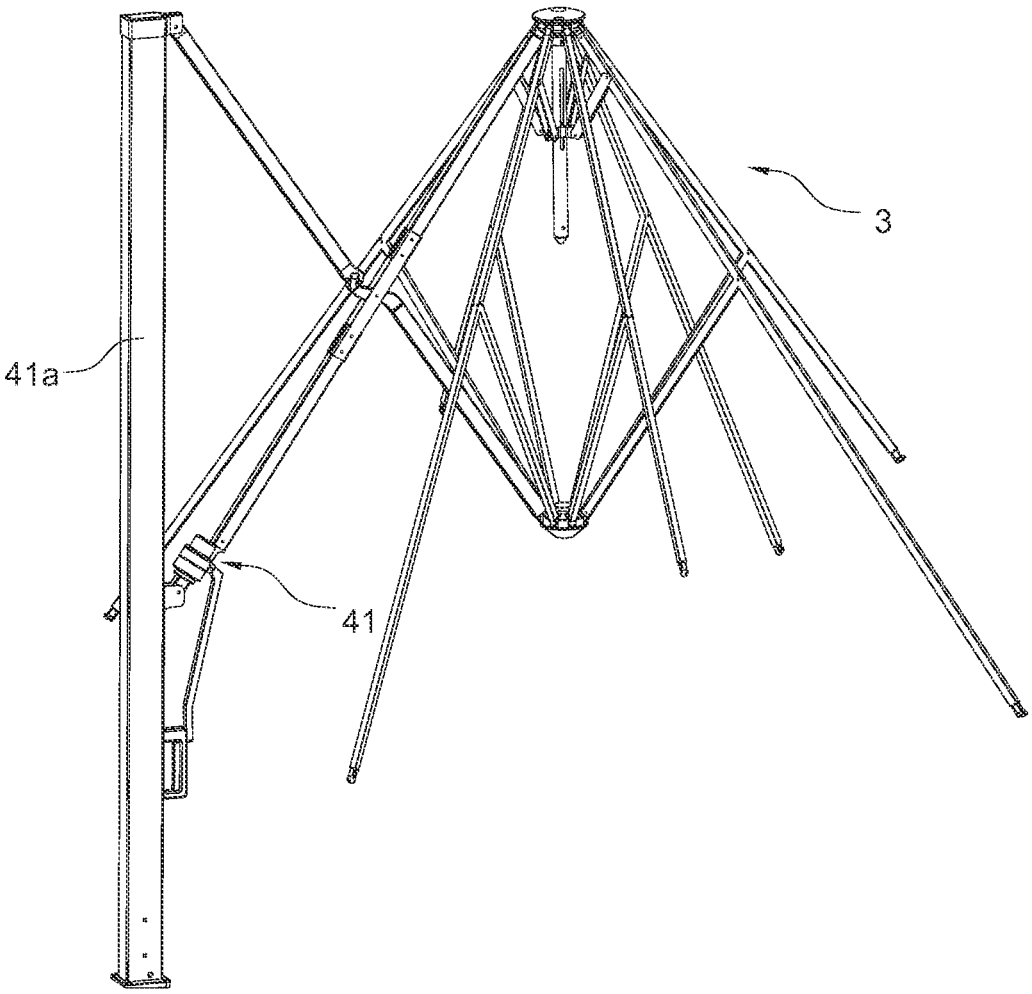
FIG. 5 is a perspective view of the umbrella in a folded state according to the embodiment.
Figure 6:
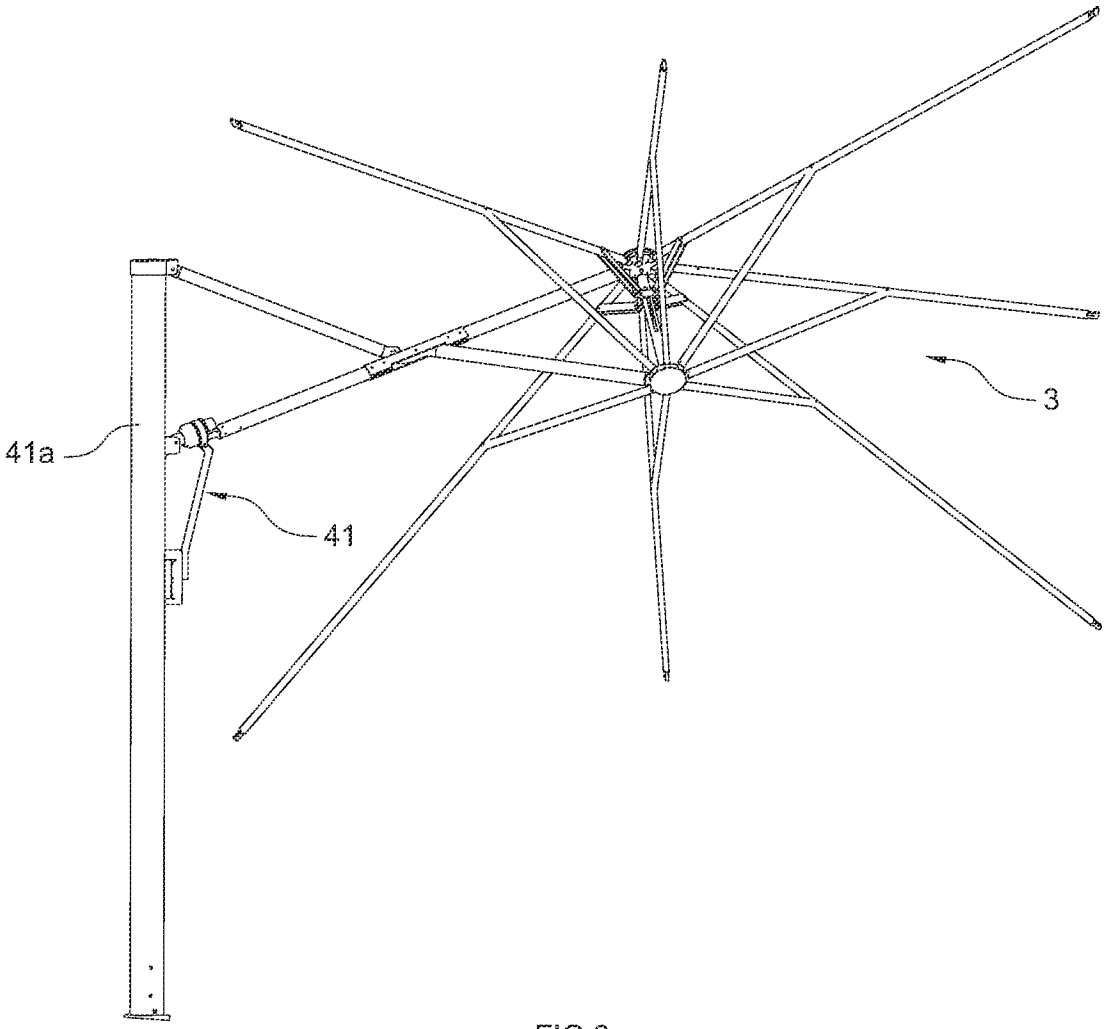
FIG. 6 is a perspective view of the umbrella in an unfolded state according to the embodiment which canopy is rotated to form an included angle with a horizontal plane.
Figure 7:
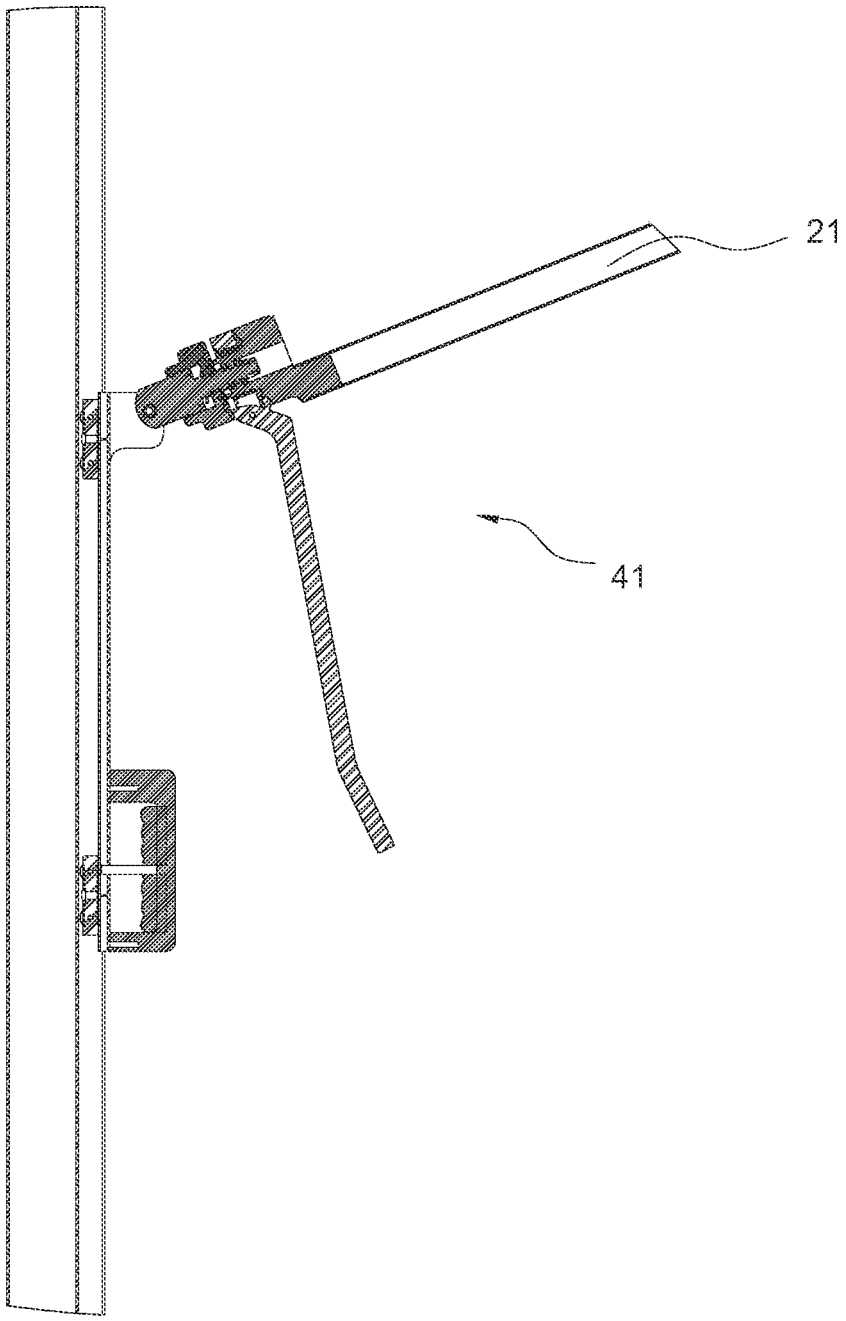
FIG. 7 is a perspective view of a clutch mechanism and a sliding block (in a separated state) of the umbrella according to the embodiment.
Figure 8:
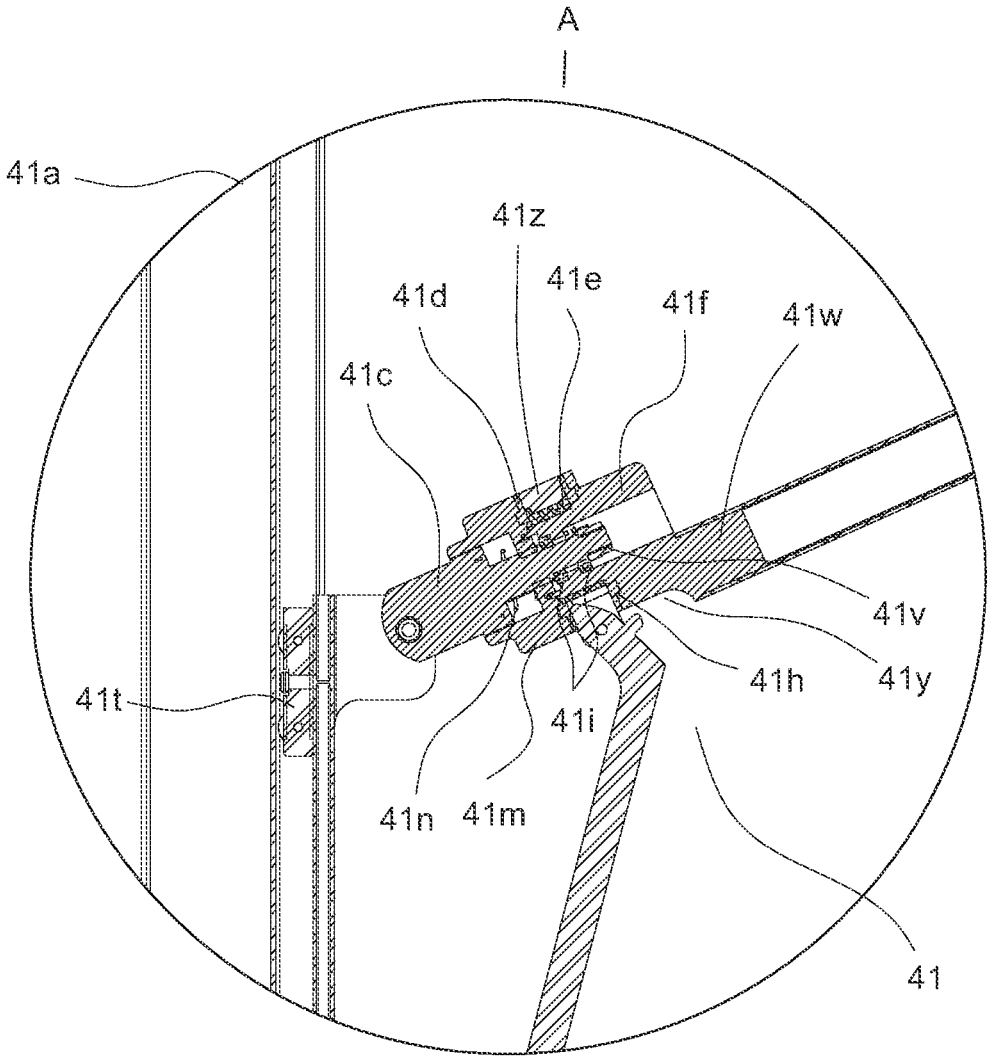
FIG. 8 is an enlarged view of Part-A in FIG. 4.

FIGS. 1-8 show a preferred embodiment of the angle-adjustable umbrella without rope of the present invention. The umbrella comprises a column 41*a* having a sliding block 41*u* slidably sleeved on the column 41*a*; a transverse rod 200 having a top end and a bottom end; a tilted rod 20 having a top end and a bottom end; an umbrella frame 3; a clutch mechanism 41; wherein, the tilted rod 20 comprises a first tilted rod 22 and a second tilted rod 27, and the top end of the first tilted rod 22 is hinged to the top of the column 41*a*; the bottom of the column 41*a* is disposed above ground through an adapter 1; the bottom end of the first tilted rod 22 is rotatably connected to a connector 24 on the second tilted rod 27 through a tilted rod joint 23; This rotatable connection can be achieved in such a way: a connecting slot 23*a* is formed on the tilted rod joint 23, and the connector 24 on the second tilted rod 27 has a connecting portion 24*a* which extends into the connecting slot 23*a* to be connected by a shaft pin, thereby realizing leftward or rightward rotation; the bottom end of the second tilted rod 27 is hinged to the lower nest 31*r* in the umbrella frame 3; and a umbrella nest support 31*s* and a lower nest cover 31*t* are disposed in the middle and the bottom of the lower nest 31*r*; the transverse rod 200 comprises a first transverse rod 21 and a second transverse rod 26 which are connected and disposed by connecting pieces 25, and the connecting pieces 25 are coupled to the tilted rod 20; Usually, the first transverse rod 21 and the second transverse rod 26 are connected and disposed by the connecting pieces 25 disposed on two sides, and a space is formed between the connecting pieces 25 to couple the connector 24. To improve the rotation flexibility, a bearing 41*i* is disposed at the coupling position, so that the transverse rod 200 and the tilted rod 20 form a hinge component. The bottom end of the transverse rod 200 is connected to a slider joint 41*c* through the clutch mechanism 41, the slider joint 41*c* is rotatably connected to the sliding block 41*u* slidably sleeved on the column 41*a*; the top end of the transverse rod 200 is rotatatbly connected to an upper nest 31*a* in the umbrella frame 3 through a first joint 31*b*. An upper nest cover 31*k* is disposed on the top of the upper nest 31*a*, and a cap 31*i* is mounted on the upper nest cover 31*k*.

The umbrella frame 3 at least comprises an upper segment 31*f*, the upper nest 31*a*, the lower nest 31*r*, long ribs 31*c*, short ribs 31*j*, a plurality of support ribs 31*d* and a middle nest 31*e* and so on; the upper nest 31*a* is connected to the upper segment 31*f*, and rotatably connected to the top end of long ribs 31*c*; one end of each short rib 31*j* far away from the lower nest 31*r* is rotatably connected to the middle portion of the long ribs 31*c*, and the other end of each short rib 31*j* is rotatably connected to the lower nest 31*r*. The bottom end of each support rib 31*d* is rotatably connected to the middle nest 31*e*, the other end of each support rib 31*d* is rotatably connected to the long ribs 31*c* near the upper nest 31*a*. A sliding block in the middle nest 31*n* is disposed in the upper segment 31*f*, and a longitudinal guide hole is distributed on the circumferential wall of the upper segment 31*f*; the sliding block in the middle nest 31*n* is connected to the middle nest 31*e* after passing through a guide hole on the wall of the upper segment 31*f*, and can slide up and down on the upper segment 31*f* together with the middle nest 31*e*.

In addition, the sliding block 41*u* further comprises slider handrails, a spring pin 41*r*, a handle 41*b* and a pulley block 41*t*; the slider handrails are disposed on the sliding block 41*u* which is connected to the pulley block 41*t* located in a slide rail in the column 41*a*, and the spring pin 41*r* is fitted with a positioning port on the opening of the slide rail, and, the action of the spring pin 41*r* is controlled by the handle 41*b*, which belongs to the conventional technology.

In this way, the umbrella frame 3 can be unfolded or folded by moving the slider component up and down along the column 41*a*. The slider component slides up and down along the column 41*a*, one end of the sliding block 41*u* is connected to the clutch mechanism 41 and drives the transverse rod 200, the tilted rod 20 and the umbrella frame 3 so as to unfold or fold the canopy. The pulley block 41*t* mounted inside the sliding block 41*u* slides up and down along the column 41*a*, and a device for positioning the handle 41*b* and the spring pin 41*r* is disposed on the sliding block 41*u* to position the canopy in the unfolded or folded state.

The structure for adjusting the canopy angle is the clutch mechanism 41 capable of adjusting the canopy angle arranged at the bottom end of the transverse rod 200. The clutch mechanism 41 is connected to the transverse rod 200 and the sliding block 41*u*, respectively. The clutch mechanism 41 at least comprises a lower clutch gear 41*m*, an upper clutch gear 41*f*, a clutch gear spring 41*n*, a lever 41*p* and a lever fixation seat 41*w*; the lower clutch gear 41*m* has a concave cavity on the bottom and can be telescopically mounted on the slider joint 41*c*, the clutch gear spring 41*n* is disposed in the concave cavity. The slider joint 41*c* usually is step-shaped and divided into a lower section and an upper section with different diameters, so that the clutch gear spring 41*n* can be sleeved on the upper section of the slider joint 41*c* and the lower clutch gear 41*m* is kept upward. The lower clutch gear 41*m* has a stop collar 41*d* on its upper end face. The upper clutch gear 41*f* is rotatably mounted on the slider joint 41*c* through a bearing 41*i* and is axially limited by a nut 41*v*, and the rear end of the upper clutch gear 41*f* is connected to the lever fixation seat 41*w*; a mounting groove 41*y* is located on a side of the lever fixation seat 41*w*; the front end of the lever fixation seat 41*w* is reduced in diameter and then disposed to a connecting sleeve 41*z* through an inner bushing 41*e*; the lower side of the connecting sleeve 41*z* has an opening, and is attached to the lever 41*p* capable of rotating by connecting pieces. Thereby, a mounting groove 41*y* is rotatably attached to the lever 41*p*, and the end of the lever 41*p* near the mounting groove 41*y* is resisted against the end face of the upper clutch gear 41*f*, so that the lower clutch gear 41*m* is separated from the upper clutch gear 41*f* against the spring force. Meshing gear is distributed on the mating end faces of the upper clutch gear 41*f* and the lower clutch gear 41*m*, and the rotation axis of the clutch gear and the upper shaft pin at the hinged connection of the transverse rod 200 and the tilted rod 20 are on the same axis.

After the umbrella is completely unfolded, the function of rotating the canopy leftward or rightward can be achieved by operating the lever 41*p*. Specifically, the lever 41*p* is pulled away from the column 41*a* and then rotated toward the canopy until the lever 41*p* and the upper clutch gear 41*f* are positioned together. That is, one section of the lever 41*p* is clamped into the mounting groove 41*y*. The end of the lever 41*p* ejects the lower clutch gear 41*m*, so that the upper clutch gear 41*f* is separated from the lower clutch gear 41*m*, and the operation of rotating leftward or rightward can be performed to achieve the desired canopy angle. The lever 41*p* drives the rotating mechanism to operate for multiple times. After the canopy is rotated to a certain angle, the lever 41*p* can be rotated toward the column 41*a* and can be restored to its original position, so that the upper clutch gear 41*f* and the lower clutch gear 41*m* are meshed together again. Furthermore, the stop collar 41*d* is mounted at the contact position of the upper and lower clutch gear and the lever fixation sear 41*w*, and the inner bushing 41*e* is mounted inside the lever fixation seat 41*w*, so that it is smoother to rotate the lever 41*p*. To achieve the leftward or rightward rotation of the canopy, a bearing rotating mechanism coaxial with the clutch gear 41 is mounted on the upper side of the hinged connection of the transverse rod 200 and the tilted rod 20, to ensure the smooth adjustment of the canopy angle.

The connection method of the umbrella frame 3 was described above, and the labor-saving mechanism mounted in the upper segment 31*f* will be further described below. The labor-saving mechanism comprises an air spring 31*p*, a sliding block in the middle nest 31*n* a guide sleeve 31*q* and other parts. The related external parts include the middle nest 31*e*, the support ribs 31*d* and the lower nest 31*r*. The specific connection method is that: a top end of the air spring 31*p* is connected to the sliding block 41*u* in the middle nest 31*n* through a screw; the air spring 31*p* and the sliding block in the middle nest 31*n* are located inside the upper segment 31*f*; the bottom end of the air spring 31*p* is connected to the guide sleeve 31*q*; and the guide sleeve 31*q* is connected to the lower end of the upper segment 31*f*. The labor-saving mechanism can effectively solve the problem of excessive thrust in folding or unfolding the parasol. The labor-saving mechanism can effectively solve the problem of excessive thrust in folding or unfolding the umbrella.

The protection scope of the present invention is not limited to each embodiments described in this description. Any changes and replacements made on the basis of the scope of the present invention patent and of the description shall be included in the scope of the present invention patent.

The invention claimed is:

1. An angle-adjustable umbrella, comprising:

a column having a sliding block slidably sleeved on the column;

a transverse rod having a top end and a bottom end;

a tilted rod having a top end and a bottom end;

an umbrella frame having an upper nest and a lower nest;

a clutch mechanism for adjusting the angle of umbrella frame;

wherein, the tilted rod comprises a first tilted rod and a second tilted rod, and the top end of the first tilted rod is hinged to the top of the column, the bottom end of the first tilted rod is rotatably connected to a connector on the second tilted rod through a tilted rod joint, the bottom end of the second tilted rod is hinged to the lower nest in the umbrella frame;

the umbrella at least comprises an upper segment, the upper nest, the lower nest, long ribs, short ribs, a plurality of support ribs, and a middle nest;

the upper nest is connected to the upper segment, and rotatably connected to top ends of the long ribs;

a first end of each short rib far away from the lower nest is rotatably connected to a middle portion of the long ribs, and a second end of each short rib is rotatably connected to the lower nest;

a first end of each support rib is rotatably connected to the middle nest, and a second end of each support rib is rotatably connected to the long ribs near the upper nest;

the transverse rod comprises a first transverse rod and a second transverse rod which are connected with each other by connecting pieces, and the connecting pieces are coupled to the tilted rod, the bottom end of the transverse rod is connected to a slider joint through the clutch mechanism, the slider joint is rotatably connected to the sliding block slidably sleeved on the column, and the top end of the transverse rod is rotatably connected to the upper nest in the umbrella frame.

2. The umbrella of claim 1, wherein the clutch mechanism at least comprises a lower clutch gear, an upper clutch gear, a clutch gear spring, a lever and a lever fixation seat;

the lower clutch gear has a concave cavity on the bottom and can be telescopically mounted on the slider joint, the clutch gear spring is disposed in the concave cavity to make the lower clutch gear be kept upward;

the upper clutch gear is rotatably mounted on the slider joint through a bearing and is axially limited by a nut, and the rear end of the upper clutch gear is connected to the lever fixation seat;

a mounting groove located on a side of the lever fixation seat is rotatably attached to the lever, and the end of the lever near the mounting groove is resisted against the end face of the upper clutch gear, so that the lower clutch gear is separated from the upper clutch gear against the spring force.

3. The umbrella of claim 2, wherein the lower clutch gear has a stop collar on its upper end face.

4. The umbrella of claim 2, wherein the front end of the lever fixation seat is reduced in diameter and a connecting sleeve is disposed on the lever fixation seat through an inner bushing;

the lower side of the connecting sleeve has an opening, and is attached to the lever capable of rotating by connecting pieces.

5. The umbrella of claim 1, wherein a labor-saving mechanism comprising an air spring, a sliding block in the middle nest and a guide sleeve is disposed in the upper segment;

the air spring and the sliding block in the middle nest are located inside the upper segment, and a top end of the air spring is connected to the sliding block in the middle nest through a screw, the bottom end of the air spring is connected to the guide sleeve, and then connected to the upper segment through the guide sleeve, the sliding block in the middle nest is connected to the middle nest after passing through a guide hole on the wall of the upper segment.

6. The umbrella of claim 1, wherein a connecting slot is formed on the tilted rod joint, and the connector on the second tilted rod has a connecting portion which extends into the connecting slot to be connected by a shaft pin.

7. The umbrella of claim 1, wherein the first transverse rod and the second transverse rod are connected with each other by the connecting pieces disposed on two sides, and a space is formed between the connecting pieces to couple the connector.

8. The umbrella of claim 1, wherein the sliding block further comprises slider handrails, a spring pin, a handle and a pulley block;

the slider handrails are disposed on the sliding block which is connected to the pulley block located in a slide rail in the column, and the spring pin is fitted with a positioning port on the opening of the slide rail, and, the action of the spring pin is controlled by the handle.

* * * * *